United States Patent [19]

Eck

[11] Patent Number: 4,867,691

[45] Date of Patent: Sep. 19, 1989

[54] CONNECTOR HAVING EXPANSIBLE BARREL WITH A LAYER OF REFLOWABLE SOLDER MATERIAL THEREON

[75] Inventor: Michael P. Eck, Wellsville, Pa.

[73] Assignee: E. I. Du Pont de Nemours and Company, Wilmington, Del.

[21] Appl. No.: 114,056

[22] Filed: Oct. 29, 1987

[51] Int. Cl.[4] ..... H01R 9/09

[52] U.S. Cl. ..... 439/82; 29/843; 439/75; 439/853; 439/876

[58] Field of Search ..... 439/81, 82, 83, 874, 439/875, 876, 74, 75, 852, 853; 174/84 R; 361/400, 401; 29/837, 839, 840, 843, 845

[56] References Cited

U.S. PATENT DOCUMENTS

| | | | |
|---|---|---|---|
| 2,846,659 | 8/1958 | Hinspater | 439/875 |
| 2,977,562 | 3/1961 | Benson | 439/75 |
| 3,141,723 | 7/1964 | Bonhomme | 339/252 |
| 3,158,425 | 11/1964 | Pritulsky | 339/258 |
| 3,288,914 | 11/1966 | Fuller et al. | 174/84 R |
| 3,296,577 | 1/1967 | Travis | 439/874 |
| 3,372,476 | 3/1968 | Peiffer et al. | 174/84 R |
| 3,818,424 | 6/1974 | Evans | 339/258 T |
| 3,827,004 | 7/1974 | Vanden Heuvel et al. | 339/221 R |
| 3,852,517 | 12/1974 | Fava | 174/84 R |
| 4,076,356 | 2/1978 | Tamburro | 339/17 C |
| 4,252,397 | 2/1981 | Eigenbrode et al. | 339/99 R |
| 4,390,221 | 6/1983 | Niles et al. | 339/17 M |
| 4,469,394 | 9/1984 | Verhoeven | 339/221 R |
| 4,545,638 | 10/1985 | Neidich | 339/205 |
| 4,552,420 | 11/1985 | Eigenbrode | 339/14 R |
| 4,717,354 | 1/1988 | McCleerey | 439/874 |

OTHER PUBLICATIONS

Brochure 2800, Du Pont Rib-Cage Connector System. Catalog 86-A, Du Pont Connector Systems, pp. 74–75, 314–315, 320, 321, 386–388.

*Primary Examiner*—Neil Abrams

[57] ABSTRACT

A contact for a connector is characterized by a barrel portion having a layer of a reflowable solderable material disposed on the inner and outer surfaces thereof. The barrel is expansible from a first to a second dimension upon the insertion of a camming member thereinto. The contact is disposed in a connector that is used in conjunction with a pin header and a board with plated through holes therein. The barrels, when inserted into the through holes from one surface of the board, are expanded by the receipt of pins or wires inserted into the barrels from a header disposed on the other side of the board. The connections between the barrels and the through holes may be mass terminated. The board assembly so formed is able to be conveniently stacked.

12 Claims, 6 Drawing Sheets

7
7
62
32
34
70
R-2
82
28
VCL
40
62
70S
78
14F-2
H
26P
24
79
76
20
14F-1
B
70S
70
70L
T
L
R-1
14S-1
22
14
14E
10A
17
16

CONNECTOR HAVING EXPANSIBLE BARREL WITH A LAYER OF REFLOWABLE SOLDER MATERIAL THEREON

BACKGROUND OF THE INVENTION

1. FIELD OF THE INVENTION

The present invention relates to a connector for forming a stack of circuit boards each one of which has an array of plated through holes therein and, in particular, to a connector for that purpose using a contact that is itself provided with an expansible barrel having a reflowable solderable material over a portion of at least the interior surface thereof.

2. DESCRIPTION OF THE PRIOR ART

It is often necessary during the manufacture of electrical apparatus to stack plural electrical circuit boards in order to achieve a desired board packaging density and/or to enhance system speed. A typical environment in which this need arises is the so-called high speed super computer. Other areas in which the need for stacked plural boards arises include personal computers, small and mid-size mainframe computers, and other computing apparatus having the need for dense packaging format.

Each of the boards has integrated circuits or discrete passive components mounted thereon. The components are connected by conductive traces formed on the board's surface. The tracings typically terminate in plated through holes. Such through holes are bores through the thickness dimension of the board that are typically lined with copper overplated with tin/lead.

An arrangement which may be used to effect the stacked interconnection of any predetermined number of boards uses a "hermaphroditic" contact. This contact is shown on pages 2 and 3 of Du Pont Connector System Ribcage Bulletin 2800 (December 1984). The hermaphroditic contact is so named because the inclusion of both a male pin and a female receptacle in the same element gives it the ability to mate with another element of the same kind. To effect a stack using hermaphroditic contacts the pin portion of the contact is inserted from a first surface of the board through the plated through hole in a board so that it extends from the opposite surface of the board. The pin is hand soldered in place. The receptacle portion of the contact projects upwardly above the first surface of the board. The pins soldered into a given board may engage into the receptacles of another board also provided with hermaphroditic contacts. The receptacles of the given board may receive the pins of yet a third board similarly provided with hermaphroditic contacts. Such an arrangement of three boards B-1, B-2 and B-3, each having plated through holes H therein, is illustrated in side section in FIG. 10. The contacts are indicated by the reference character C. In a similar manner any number of boards may be stacked by simply inserting the pins from one of two vertically adjacent boards into the receptacles on the other of the vertically adjacent boards.

The use of hermaphroditic contacts to form stacks of boards has readily identifiable disadvantages associated therewith. Prominent among the disadvantages is the time required to effect a hand-soldered interconnection between each individual pin and its associated plated through hole. When one considers that thousands of such solder joints may be required in a given installation it is quickly realized that a serious drawback in manufacturing cost attends the use of hand soldered hermaphroditic contacts to form stacked boards. In addition the reliability of the hand soldered joints is open to question.

Accordingly, in view of the foregoing it is believed to be advantageous to provide a connector whereby a stacked plurality of two or more boards having plated through holes therein may be effected that avoids the drawbacks of the presently available system.

SUMMARY OF THE INVENTION

The present invention relates to a contact element having an expansible barrel thereon and to a connector incorporating the contact therein. The contact element has a mating portion integrally formed with the barrel. The interior and exterior surfaces of the contact are provided with a layer of reflowable solderable material. The barrel has a first and a second axially extending slot therein. The slots define a pair of lobes on the barrel. Each lobe has a pivotally mounted finger formed thereon. By virtue of the slots the barrel is responsive to a camming force imposed thereon by the insertion of a camming member thereinto to expand from a first radial dimension to a second radial dimension. In addition the fingers are themselves pivotal in response to the introduction of the camming member to pivot from a first radial position in which the fingers lie within the outside dimension of the barrel to a second radial position in which the outer surface of the fingers lie at least on the outside surface of the barrel. The fingers may be pivotal radially beyond the outside surface of the barrel.

The connector using the contacts of the present invention is useful to form a circuit board assembly comprised of a board having an array of plated through holes therein, a connector body having a plurality of the contacts in which the barrel of each contact projects above the body of the connector into one of the plated through holes, and a pin header having an array of camming pins each of which is extensible into one of the barrels of the connector to expand the same into contact with the plated through hole. Thereafter the board assembly is exposed to a vapor reflow process whereby the solderable material on the surface of the barrel is reflowed to form a solder joint with the through hole. Such an arrangement permits the mass soldering of the connector into the through holes of the board.

BRIEF DESCRIPTION OF THE DRAWINGS

The invention will be more fully understood from the following detailed description thereof taken in connection with the accompanying drawings which form part of this application and in which.

DETAILED DESCRIPTION OF THE INVENTION

Figure 1:
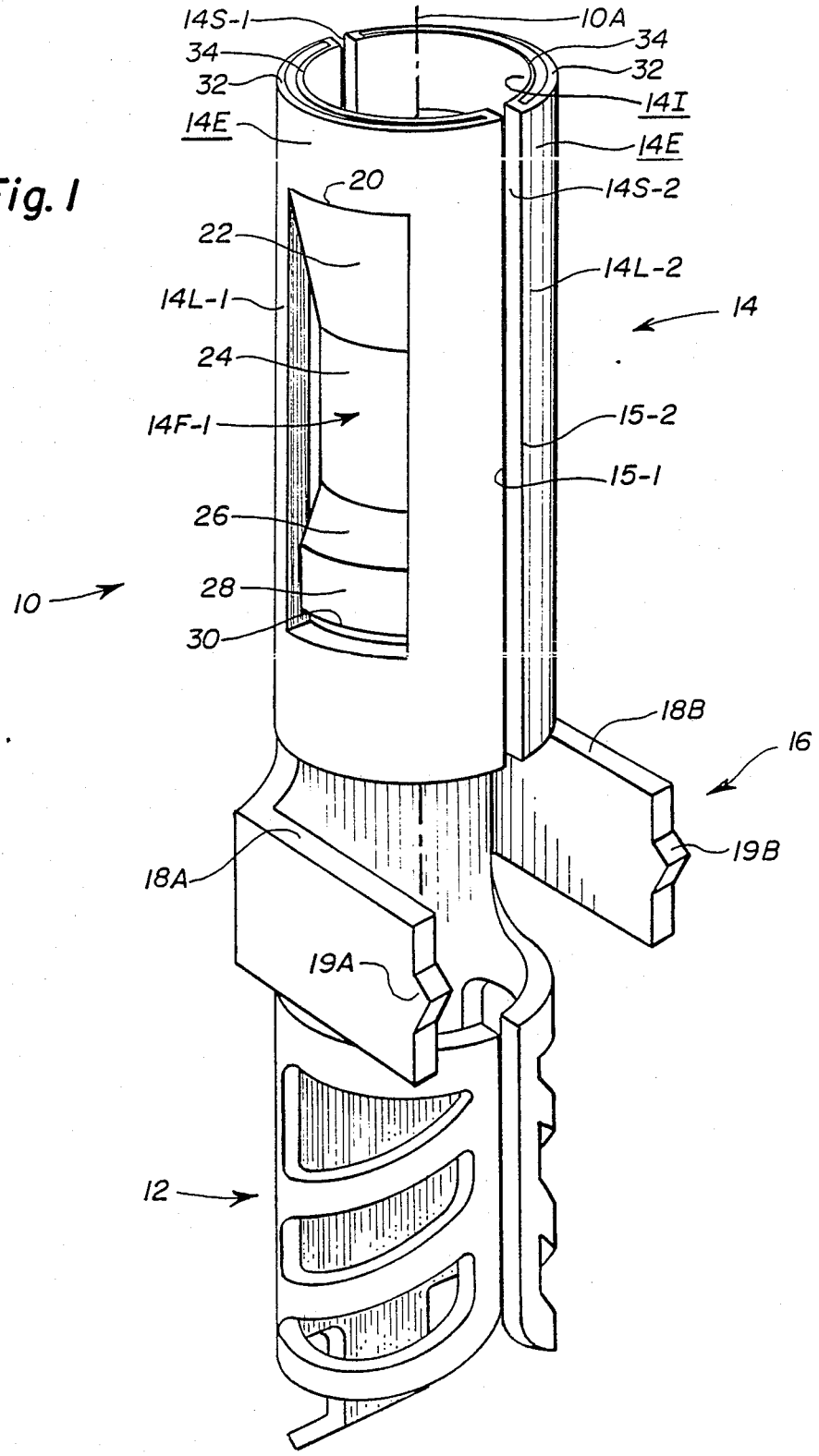
FIG. 1 is a perspective view of a contact element used in a connector in accordance with the present invention.

Throughout the following detailed description similar reference numerals refer to similar elements in all Figures of the drawings.

FIG. 1 illustrates an isolated perspective view of a contact generally indicated by reference 10 in accordance with the present invention. The contact 10 has a longitudinal axis 10A associated therewith. The contact 10 includes a mating portion 12 integrally connected with a barrel portion 14 through a transition region 16. The axes of the mating portion 12 and of the barrel portion 14 are coincident with the axis 10A of the contact 10. The contact 10 is formed from beryllium copper stock although other suitable materials may be used.

The mating portion 12 in the preferred case takes the form of a female ribcage type connector such as that sold by the Interconnect and Packaging Systems Division of E. I. Du Pont de Nemours and Company, Inc. Such a connector is disclosed, for example, in U.S. Pat. Nos. 4,445,747 and 4,545,638, both of which are assigned to the assignee of the present invention. It should be understood that the mating portion 12 may exhibit either a male or a female configuration and still remain within the contemplation of the present invention. Typically, the overall length of the contact 10 is on the order of 0.200 inches, with the length of the barrel portion 14 occupying approximately half of the overall length.

The transition region 16 is provided with a retaining arrangement which in the preferred instance may take the form of a pair of arms 18A, 18B. Each arm 18A, 18B is provided with a retaining barb 19A, 19B, respectively. Of course, any other suitable configuration for the retaining arrangement may be used.

The barrel portion 14 is provided with an inner surface 14I and an exterior surface 14E thereon. In the preferred case the barrel 14 is generally cylindrical in shape, although it should be understood that it need not be so limited. The barrel portion 14 is interrupted by at least one but preferably two slots 14S-1 and 14S-2. The slots each extend in a generally axial direction with respect to the axis 10A of the contact 10. The presence of the slots 14S-1 and 14S-2 permits the barrel portion 14 to radially expand (with respect to the axis 10A) from a first predetermined radial dimension to a second, enlarged, predetermined radial dimension, all for a purpose to be more fully explained herein. Any suitable structural expedient that permits the radial expansion of the barrel should be understood to lie within the contemplation of the present invention.

The slots 14S-1 and 14S-2 also serve to define a first and a second generally semi-cylindrical lobe 14L-1 and 14L-2 in the barrel portion 14. The slot 14S-1 extends down the back of the barrel 14 and terminates at the transition portion 16 of the contact 10. The material of the transition portion 16 of the contact 10 defines a web or hinge 17 (FIG. 4) at the lower end of the slot 14S-1 which will, in a manner to be described, facilitate the jaw-like articulation or flexing action of the lobes 14L-1, 14L-2 and thereby assist in the radial expansion of the barrel 14. The slot 14S-2, on the other hand, is formed in the barrel 14 in such a manner as to totally separate the confronting edges 15-1, 15-2, respectively, of the lobes 14L-1, 14L-2. The presence of the slot 14S-2 permits the edges 15-1, 15-2 of the lobes 14L-1, 14L-2, respectively, to circumferentially separate or grow apart, thereby aiding the radial expansion of the barrel 14. The lobes 14L-1 and 14L-2 are each provided with a finger 14F-1 and 14F-2, respectively. The finger 14F-2 is not visible in FIG. 1 but is visible, for example, in FIGS. 4, 5, 6, and 7.

Each finger 14F-1 and 14F-2 has a line of bending 20 along which the finger is articulably connected to its associated lobe 14L-1, 14L-2, as the case may be. Each finger includes a first, cam, portion 22 integrally formed with a second, contact, portion 24, a third, transition, portion 26 and a fourth, stop, portion 28 terminating in a free end 30.

A predetermined region of the interior surface 14I and of the exterior surface 14E of the barrel 14 is provided with a layer of a reflowable solderable material indicated by reference characters 32, 34, respectively. In the preferred instance the layers 32, 34 of the reflowable solderable material are conveniently provided over the entire interior surface 14I and the entire exterior surface 14E of the barrel 14. However, as a minimum, the reflowable solderable material should be provided on at least the interior surface of the contact portion 24 of each of the fingers 14F-1 and 14F-2. In addition, if the reflowable solderable material is provided on the exterior surface of the barrel, at least the portions of the exterior surface 14E thereof above and below the fingers should carry the layer of this material.

The term "reflowable solderable material" is meant to include any alloy which when exposed to a temperature of approximately 420° F. goes from a solid to a flowable state. Preferably the material is a 60/40 or 93/7 alloy of tin and lead. A thickness for each layer 32, 34 on the order of two hundred to three hundred micro inches is preferred.

Figure 9:
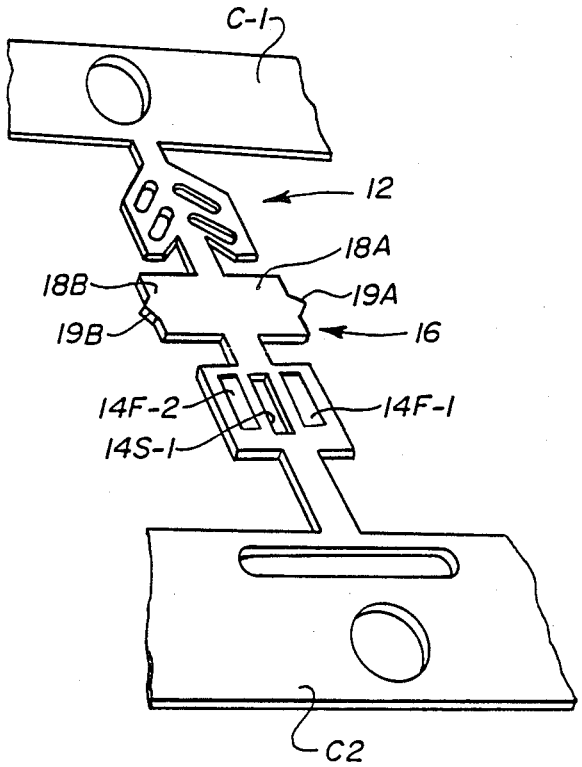
FIG. 9 is an isolated perspective view of a blank used to form a contact as illustrated in FIG. 1.

A contact 10 as hereinbefore described may be formed in any convenient manner. One suggested mode of formation of the contact may be understood with reference to FIG. 9, which illustrates an isolated perspective view of a blank from which the contact 10 may be formed. The material used to form the contact 10 is on the order of 0.0033 inches in the typical case although material of other thicknesses may be used. In such a case the flexibility and pliability of the contact may be correspondingly limited. The blank is carried by first and second carrier strips C-1 and C-2. The blank is first stamped to form the details of the mating portion 12, the retaining arms 18 and the barrel portion 14. In particular, with respect to the barrel portion 14, the stamping forms the fingers 14F-1, 14F-2 and the gap which will, when fully assembled, define the slot 14S-1. The blank is thereafter plated over the entire interior and exterior surfaces of the barrel portion 14 with the layers of the reflowable solderable material. If only selective regions of the barrel are to be so plated, precautions are taken to cause this to occur. The plated blank is thereafter formed in a suitable die whereby the configurations of the mating portion 12, the transition portion 16 and the barrel portion 14 are imparted to the structure. Since the portions of the blank that will form the fingers 14F-1, 14F-2 have been stamped from the blank while it is the form of a flattened piece of stock, it should be observed that when the blank is formed in the die the lobes of the barrel will have imparted to them a generally cylindrical configuration while the fingers themselves will remain in a generally planar configuration. This will, as will be developed herein, permit the fingers to possess a slightly greater breadth than the breadth of the opening in the stock from which the fingers were formed, at least on the interior surface of the barrel. As will be explained, as a result, when the fingers are radially expanded in response to the introduction of a camming member into the barrel the fingers will act against the interior of the lobes of the barrel to assist in the expansion thereof. The formed contact is then detached from the carrier strips C-1, C-2 and deposited into a housing to form a connector which is to be described herein.

Figure 2:
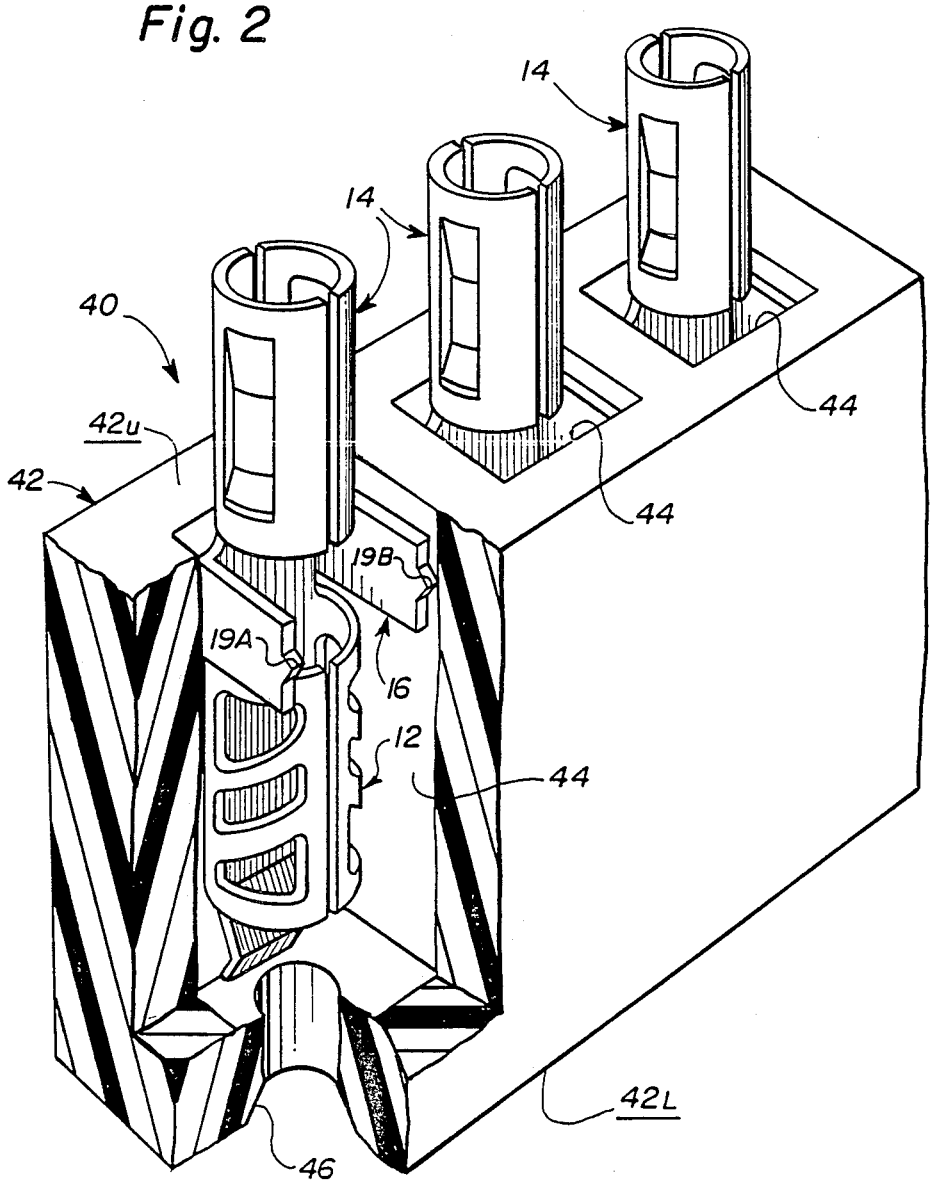
FIG. 2 is a perspective view of a connector in accordance with the present invention having a plurality of contact elements as shown in FIG. 1.

The plurality of contacts 10 of the type shown in FIG. 1 may be incorporated in a connector which can be used to form a stack of plural circuit boards. Such a connector is shown in FIG. 2 and is indicated by the reference character 40. The connector 40 includes a housing 42 that is formed as a body of a suitable plastic material, such as the polyester engineering thermoplastic resin sold by E. I. du Pont de Nemours and Company, Inc. under the trademark "RYNITE." The material selected for the housing 40 must be able to withstand the temperatures of the reflow process to be described. The housing 42 has an upper surface 42U and a lower surface 42L thereon. The housing 42 is provided with a plurality of recesses 44, each of which is sized to receive a contact 10. The mating portion 12 and the transition portion 16 of each contact 10 is received within the housing 42 and is there retained by the action of the retaining barbs 19. The barrel portion 14 projects above the upper surface 42U of the housing 42. A tapered lead-in aperture 46 is provided in the lower surface 42L of the housing 42 whereby a mating member may be received within the housing 42 in mating engagement with the mating portion 12 of the contact 10 in a manner to be described. Such a mating member may take any desired configuration as long as it is compatible with the mating portion 12 of the contact 10.

Figure 3:
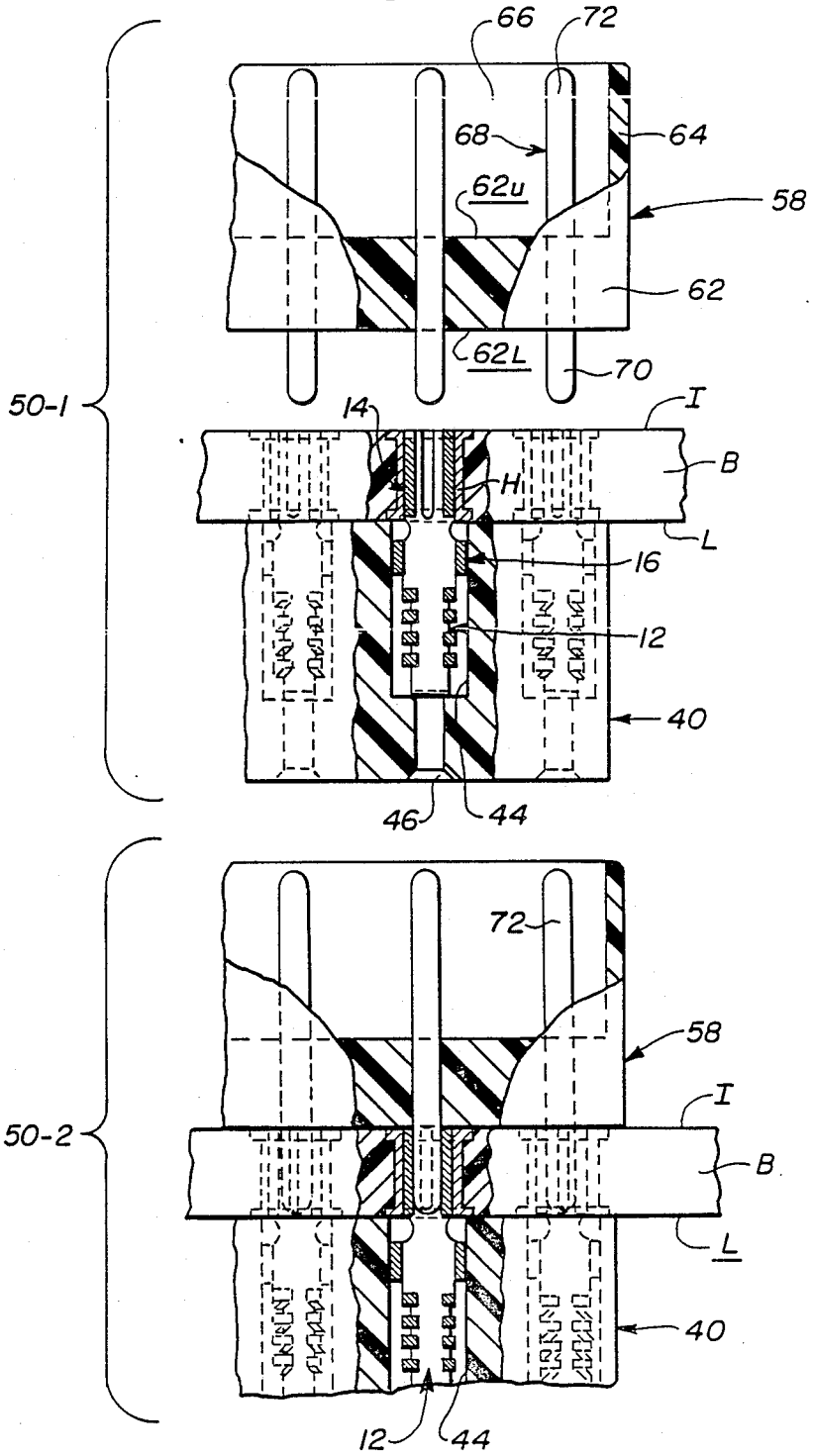
FIG. 3 is an exploded side elevational view of a pair of circuit board assemblies each having a board with plated through holes, a connector as shown in FIG. 2 attached at the lower surface of the boards and a pin header attached at the upper surface of the boards, with the connector and the header having a portion broken away.

As shown in FIG. 3 the connector 40 such as that illustrated in FIG. 2 may be used in conjunction with a circuit board B to form a board assembly generally indicated by the reference character 50 whereby a stacked interconnection of a first board assembly 50-1 with an adjacent second board assembly 50-2 may be formed. In FIG. 3 an upper circuit board assembly 50-1 and a lower circuit board assembly 50-2 are shown. Each board assembly 50 comprises a circuit board B that has an array of plated through holes H formed therein. Each of the holes H in the boards B is plated with a plating composition, typically a 60/40 tin/lead composition. For a board B having plated through holes H on 0.050 inch center-to-center spacing typical diameter of the hole H is on the order of 0.023 inches nominal.

Each board B defines a top surface T and a lower surface L. The board assembly 50 further includes a connector 40 as shown in FIG. 2 that is disposed adjacent to one of the surfaces of the board 50, e.g., the lower surface L. The connector 40 is arranged such that the projecting barrel portions 14 of the contacts 10 used therein are received into the plated through holes H provided in the board B. The barrels 14 are sized for loosely fitting receipt within the plated through holes H. The barrels 14 are sized and project above the upper surface 42U of the housing 42 such that the upper end of the barrel 14 extends completely through the thickness dimension of the board B. Within dimensional variations the upper end of the barrel 14 is substantially flush with the top surface T of the board.

The final component of the board assembly 50 is a pin header 58, which in the typical case takes the form of a plastic body 62 having a shroud member 64 surrounding a recess 66. The body 62 is formed of a material similar to the material used for the housing 42 of the connector 40 as it too must be able to withstand the temperatures of the reflow process. The body 62 has an upper surface 62U and a lower surface 62L thereon. An array of contact members 68 is carried by the housing 62. The contacts 68 have a first contact portion 70 that project from the lower surface 62L of the housing 62. The portion 70 is a male pin member. The pin 70 is illustrated herein as having a rectangular cross section (see FIG. 7) but it is to be understood that the pin may have a circular, square or other configuration. The pin 70 may have a layer 70L (FIG. 7) of reflowable solderable material thereon. In addition the contact 68 has an upper contact portion 72 that is received within the shrouded recess. This portion 72, although shown in the Figures as another male pin, may take either pin or receptacle form, so long as this contact portion 72 is compatible with the form of the mating portion 12 of the contact 10 used in the connector.

Figures 4, 5, 6:
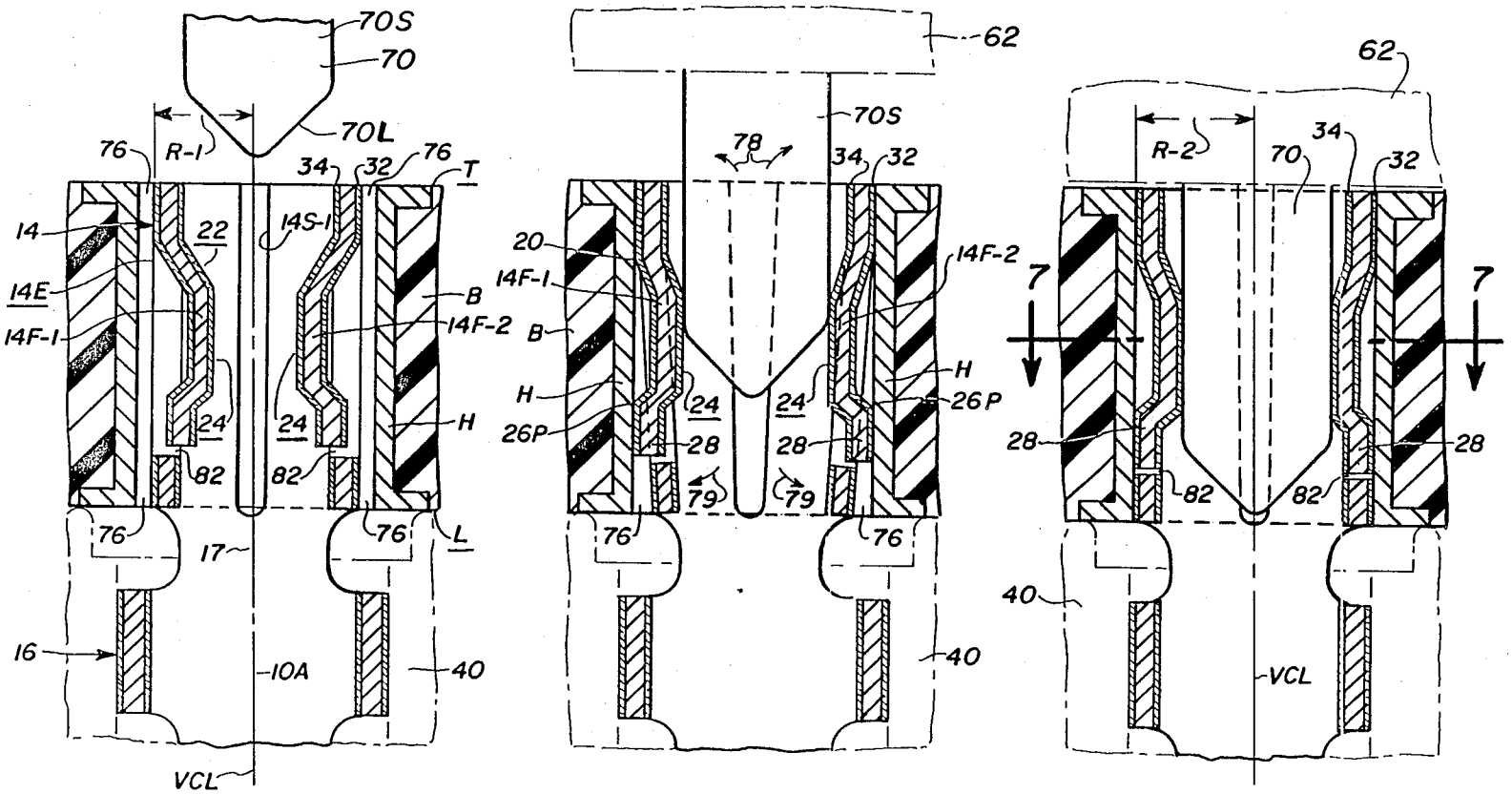
FIGS. 4, 5, and 6 are side elevational views in section of the relationship of the upper circuit board assembly shown in FIG. 3 as a pin header is progressively inserted into the barrels of the connector already introduced into the through holes of the circuit board.

The steps in the formation of the circuit board assembly 50 are believed to be seen best in connection with FIGS. 3 through 7. As shown in FIGS. 3 and 4, the barrels 14 from the contacts 10 in the connector 40 are inserted through the through holes H in the board B with which they are associated. In the illustrations the connector 40 is disposed adjacent to the lower surface L of the board B. Thereafter the lower contact pins 70 from the pin header 58, each acting as a camming member, are inserted axially into the plated through holes H from the opposite side (in this case, the top surface T) of the board B.

The barrel portion 14 of each of the contacts 10 of the connector 40 define, in their unexpanded state as shown in FIGS. 1, 2, and 4, a first predetermined radial dimension R-1 as measured with respect to the axis 10A extending through the barrel 14. Generally, this dimension is less than the dimension of the through hole H. The barrel 14 is therefore rather loosely received within the plated through hole H. This is shown in FIG. 4 by the clearance spacing 76 extending as an annular volume about the surface of the barrel 14.

In accordance with the present invention the barrel 14 expands radially to close the clearance spacing 76 and to bring the exterior surface 14E of the barrel 14 into a snugly fitting relationship with the plated through hole H by two distinct mechanisms.

As the tapered leading edge 70L of the end of the camming pin 70 is inserted into the barrel 14 the pin 70 strikes against the camming surface 22 provided on the fingers 14F-1 and 14F-2. This action causes the upper end of the barrel 14 to radially expand. The expansion is occasioned by the jaw-like articulation or flexing action plus the circumferential separation of the lobes 14L-1, 14L-2. The lobes 14L-1, 14L-2 are permitted to expand by the presence of the slots 14S-1, 14S-2 formed in the barrel 14.

As may be seen in FIG. 5, the introduction of the camming member 70 in the form of the pin 70 into the barrel 14 closes the upper region of the clearance space 76. Close inspection of FIG. 5 indicates that the clearance space 76 is still extant between the lower region of the barrel 14 and the plated through hole H. The lobes of the barrel 14 are, in effect, permitted to tilt radially outwardly with respect to the axis 10A. This jaw-like articulation of the lobes 14L-1, 14L-2, as indicated by the arrows 78 (FIG. 5), occurs as the pin 70 is introduced into the barrel 14. The slot 14S-1 and the hinge 17 defined by the material of the transition portion 16 of the contact permits the jaw-like articulation of the lobes. In addition, the presence of the slot 14S-2 permits the edges 15-1, 15-2 (FIG. 1) of the lobes 14L-1, 14L-2 to circumferentially separate or to grow apart as the pin 70 is inserted into the barrel 14. The combination of these actions results in the radial expansion of the barrel 14.

Continued axial advancement of the pin 70 into the barrel 14 brings the side surface 70S of the pin 70 into abutting contact with the contact surfaces 24 of the fingers 14F-1, 14F-2 (FIG. 5). This action begins the second distinct expansion response of the barrel 14 to the camming force imposed by the pin 70. The fingers 14F-1, 14F-2 pivot in the radially outward direction about the line of bending 20. The pivotal motion is indicated by the arrows 79 (FIG. 5). By virtue of the pivotal movement the fingers radially expand from their first position (wherein the fingers lie within the outside dimension of the barrel) to a second position in which the fingers are spaced away from the axis at least as far as the exterior surface of the barrel. The points 26P (FIG. 5) on the exterior surface of the fingers 14F-1, 14F-2 are brought into abutting contact with the interior surface of the through hole H. The fingers are pivotal to an even greater radial extent (i.e., radially beyond the exterior surface of the barrel) if necessary to place the outer surface of the fingers into contact with the through hole H.

It will be also recalled that since the fingers 14F-1, 14F-2 are stamped from the blank used to form the contact prior to the bending of the blank to form the generally cylindrical barrel portion the fingers retain a generally planar configuration while the barrel is arcuate. This is seen in the sectional view shown in FIG. 7 in which the inside surface of the fingers appears as a line. The fingers possess a slightly greater circumferential breadth dimension than the circumferential breadth dimension of the barrel (at least adjacent to the inside surface of the barrel). Thus, the fingers abut against the interior surface 14I of the barrel 14 and assist in urging the barrel radially outwardly.

The passage of the pin 70 through the barrel flattens the fingers 14F-1, 14F-2 radially outwardly with respect to the axis 10A through the barrel 14, thus placing at least a portion of the outer surface of the fingers (e.g., the outer surface of the stop portion 28) into a snugly fitting relationship with respect to the through hole H. It should be observed that as the pin 70 flattens the fingers 14F-1, 14F-2 the axial gap 82 defined between the lower end of the stop portion 28 on the fingers 14F-1, 14F-2 and the remainder of the barrel 14 is slightly closed.

These two distinct expansion mechanisms, namely: (1) the radially enlargement of the lobes 14L-1, 14L-2 of the barrel 14 permitted by the slots 14S-1, 14S-2; as well as (2) the radial pivotal expansion and flattening of the fingers 14F-1, 14F-2; permit the barrel to expand radially outward with respect to the axis 10A from the first radial dimension R-1 in which the barrel 14 is somewhat loosely received in the through hole H to a second radial dimension R-2 (FIG. 6) in which a portion of the exterior surface 14E of the barrel 14 is brought to bear in a snugly fitting relationship with the surface of the plated through hole H. The barrel is thus able to be received into and expand to snugly fit within any one of a predetermined range of diameters of through holes H.

Since in the embodiment discussed the radial expansion of the fingers assists the radial expansion of the lobes of the barrel the two expansion mechanisms are somewhat interrelated. It should be understood, however, that by appropriately configuring and sizing the fingers the expansions above discussed can be made to occur independently of each other. Thus a contact in accordance with the present invention is able to exhibit one or the other or both of the expansion mechanisms discussed.

Figure 7:
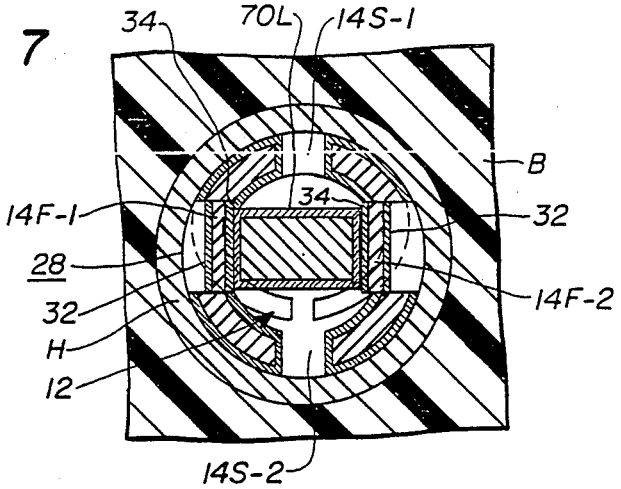
FIG. 7 is a sectional view taken along section lines 7—7 in FIG. 6 indicating the relationship of the board, barrel of the connector and the pin of the header in the fully assembled condition.

The snugly fitting interrelationship of the barrel with respect to the through hole H is also shown in FIG. 7. In this Figure the relative diameters of the barrel portion 14 and the mating portion 12 may also be discerned.

It should be appreciated that interrelationships such as described for a selected barrel 14 and through hole H occur substantially simultaneously as the entire pin header 58 is inserted into the through holes H of the board B. Once all of the barrels 14 of the connector 40 have been expanded in a manner analogous to that described into the snugly fitting relationship with the through holes H in the board B the entire board assembly is passed through a reflow process. In a reflow process the board assembly is introduced into a chamber in which a reflow gas is present. The reflow gas is produced using a liquid such as that sold by 3M Inc. as "Flourinert FC-70". The gas has a temperature greater than the reflow temperature of the reflowable solderable material in the layers 32, 34 on the barrel 14 and causes the material to flow. The board assembly is removed from the chamber and upon cooling the material forms an integral solder joint between the exterior surface 14E of the barrel 14 and the plated through hole H and between the interior surface 14I of the barrel 14 and the pin 70. It should be appreciated that the formation of all of the solder joints necessary to interconnect the connector 40, the board B and the pins 70 of the header 58 to produce the board assembly occur substantially simultaneously, thus eliminating the necessity of hand-forming the individual solder connections.

Figure 8:
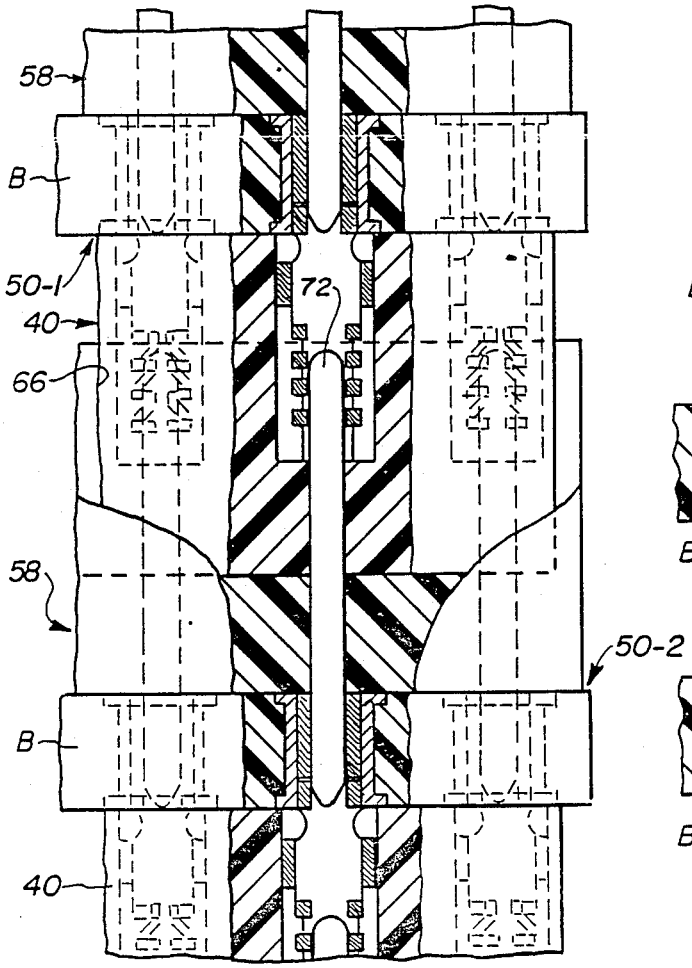
FIG. 8 is a side elevational view entirely in section illustrating a stacked arrangement of circuit board assemblies in the fully assembled condition.

A circuit board assembly formed in the manner described may then be interconnected with one and/or two vertically adjacent board assemblies. In FIG. 8 the board assembly 50-1 is shown as interconnected with one vertically adjacent assembly 50-2. The housing of the connector 40 for the board assembly 50-1 is received within the shrouded recess 66 of the pin header 58 of the board assembly 50-2. It is to be understood the board assembly 50-1 may also be connected to a second adjacent assembly (not shown) disposed vertically thereabove. The interconnection would be effected between the upper pin portions 72 of the header 58 that forms part of the board assembly 50-1 and the mating portions of the contacts 10 used in the connector 40 of the vertically adjacent board assembly.

Figure 10:
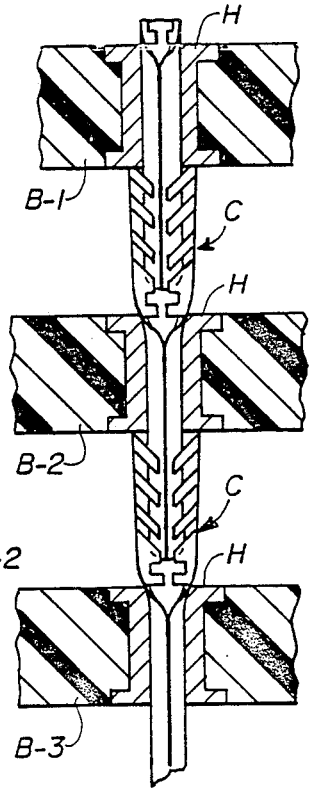
Fig. 10 PRIOR ART
FIG. 10 is a side elevational view similar to FIG. 8 of a stacked arrangement of circuit boards in accordance with the prior art.

Although the resulting board stack has a greater vertical profile than a corresponding three-board stack using the prior art hermaphroditic connectors (as is shown in comparative scale in FIG. 10), the advantage of forming a board assembly using the connector of the present invention is to eliminate the large number of hand formed solder joints that were heretofore necessary.

It should be understood that the contact 10 may be used in isolation, rather than as part of a connector 40. For example, it lies within the contemplation of the present invention to use the contact 10 in a situation in which a bare wire serves as the camming member in place of the pin 70 used in the embodiment of the other Figures. The wire may be either solid (e.g., 30 AWG) or multistranded. The wire is inserted into the barrel 14 of the contact 10 and the barrel expands in the same manner as is discussed earlier in connection with the insertion of the pin. The end of the wire is thus snuggly grasped by the contact. When the wire has been fully inserted into and snuggly seated within the barrel the same reflow process is again used to form a solder connection between the wire and the contact.

In view of the foregoing discussion it should be appreciated that the expansible barrel 14 results in a contact member that is extremely forgiving in nature. That is to say, the barrel remains able to expand snugly fit within a plated through hole over a wide range of dimensional tolerances around the nominal dimensions of the plated through hole H, the inside diameter and the outside diameter of the barrel 14, and/or the camming member 70. The pivotal action of the fingers also assists in the ability of the barrel to expand to snugly fit within the plated through hole in the board. Because of the dimensions of the materials used to form the contact (i.e., on the order of 0.0033 inch stock) the barrel is, in the typical instance, immune to aberrations in the size and shape of the fingers and/or the openings remaining from the formation of the fingers, and immune to misorientation of the fingers with respect to the barrel as the camming member is advanced through the barrel. Of course, as thickness of the material used to form the contact becomes greater, some of the latitude of the contact in this regard is curtailed. The overall point to be noted is, however, that the contact in accordance with the present invention is radially expansible due to the mechanisms discussed to generate a snug fit within a plated through hole of a board over a generally wide range of dimensional variables.

In view of the foregoing it may now be readily appreciated that in accordance with the present invention a connector is provided that greatly eases the problem of forming circuit board assemblies suitable for stacking without the necessity of making the plurality of hand soldered connections as required by the prior art. By the expedient of merely inserting the mating contacts 72 of a pin header 58 associated with a given board with the mating portions 12 of a contact 10 provided in the connector 40 of an adjacent board any predetermined number of board assemblies may be stacked.

Those skilled in the art having the benefit of the teachings of the present invention may effect numerous modifications thereto. These modifications are to be construed as lying within the contemplation of the present invention as defined in the appended claims.

What is claimed is:

1. A contact having a mating portion and a barrel portion, the contact comprising:

a barrel having an axis therethrough, the barrel having an interior surface and an exterior surface thereon, at least the interior surface of the barrel having a layer of a reflowable solderable material over a portion thereof, the barrel having a first and a second axially extending slot provided therein, the slots cooperating to define a first and a second lobe each one of which has an inwardly directed finger thereon, each finger having a pivot end and a free end thereon, the lobes being articulably movable and the fingers being pivotally movable, both the movements of the lobes and of the fingers being in response to the introduction of the camming member into the barrel, the fingers moving from a first radial position in which the free ends of the fingers are a first radial distance from the axis to a second position in which the free ends of the fingers are displaced from the axis for at least a second radial distance no less than the radial distance that the exterior surface of the barrel lies from the axis.

2. The contact of claim 1 further comprising a transition region integrally formed with and disposed between the mating portion and the barrel portion, a retaining barb being disposed on the transition portion.

3. The contact of claim 1 wherein the mating portion is a female receptacle.

4. A connector for use with a board having plated through holes therethrough, the connector comprising:

a housing having a recess therein, an aperture being defined in the housing in communication with the recess, a contact element partially disposed within the recess, the contact element having an integral mating portion disposed in the recess and a barrel portion, the barrel portion extending out of the housing for a predetermined distance thereabove, the barrel portion having an interior surface and an exterior surface thereon, the barrel having a layer of a reflowable solderable material over at least some portion of the interior surface thereof, the barrel portion having an axis therethrough, and a pair of axially extending slots cooperating to define a first and a second lobe thereon, each lobe having a portion thereof formed into a finger having a pivot end and a free end thereon, each finger being pivotally movable with respect to the lobe with which it is associated from a first radial position in which the free ends of the fingers are a first radial distance from the axis to a second radial position in which the free ends of the fingers are displaced from the axis for at least a second radial distance no less than the radial distance that the exterior surface of the barrel lies from the axis, the radial expansion of the barrel with respect to the axis from the first radial dimension to the second radial dimension in response to the introduction of a camming member thereinto being accommodated by the articulation of the lobes and by the pivotal motion of the fingers.

5. The connector of claim 4 wherein each finger has an exterior surface thereon with a reflowable solderable material over some portion of the exterior surface.

6. The connector of claim 4 wherein the mating portion is a female receptacle.

7. The connector of claim 6 further comprising a transition portion disposed between the mating portion and the barrel portion, the transition porting having a retaining arrangement thereon, the retaining arrangement retaining the contact within the housing.

8. A circuit board assembly comprising:

a circuit board having a plurality of through holes therein, each through hole being plated with a reflowable solderable material;

a connector comprising:

a housing having a recess therein, an aperture being defined in the housing in communication with the recess, a contact element partially disposed within the recess, the contact element having an integral mating portion disposed in the recess and a barrel portion, the barrel portion extending out of the housing for a predetermined distance thereabove, the barrel portion having an interior surface and an exterior surface thereon, the barrel having a layer of a reflowable solderable material over at least some portion of the interior surface thereof, the barrel portion having an axis therethrough and a pair of axially extending slots cooperating to define a first and a second lobe thereon, each lobe having a portion thereof formed into a finger having a pivot end and a free end thereon, each finger being pivotally movable with respect to the lobe with which it is associated from a first radial position in which the free ends of the fingers are a first radial distance from the axis to a second radial position in which the free ends of the fingers are displaced from the axis for at least a second radial distance no less than the radial distance that the exterior surface of the barrel lies from the axis, the radial expansion of the barrel with respect to the axis from the first radial dimension to the second radial dimension in response to the introduction of a camming member thereinto being accommodated by the articulation of the lobes and by the pivotal motion of the fingers; and a header comprising a body having an upper and a lower surface thereon, the body having a plurality of contact members therein, each contact member including a male pin projecting from one surface of the body, each pin being received as a camming member in the barrel portion disposed in one of the plated through holes in the board, the expansion of each barrel in response to the introduction of a pin thereinto disposing the exterior surface of that barrel and each of the fingers thereon into contact with the plated through hole in which it is disposed.

9. The board assembly of claim 8 wherein the mating portion of each contact member of the connector is a female receptacle and wherein the contact member of the header includes a second male pin projecting from the other surface of the body of the header.

10. The connector of claim 8 wherein the mating portion of the contact element is a female receptacle.

11. The connector of claim 8 further comprising a transition portion disposed between the mating portion and the barrel portion, the transition porting having a retaining arrangement thereon, the retaining arrangement retaining the contact within the housing.

12. A method of forming a circuit board assembly comprising the steps of (a) introducing each barrel portion on a connector having an insulating housing with a predetermined plurality of barrels partially projecting therefrom into one of a plurality of through holes in a circuit board, each barrel having a layer of reflowable solderable material on the inside surface thereof, each through hole being lined with a reflowable solderable material, (b) simultaneously inserting each of the plurality of pins carried by a pin header having a body with a predetermined plurality of pins projecting therefrom into one of the barrels thereby to urge the outside surface of each barrel into contact with the through holes, and (c) exposing the assembly produced by steps a and b to an environment to initiate the reflow of the solder on the through holes and the barrels, thereby to interconnect the same substantially simultaneously.

* * * * *